United States Patent [19]

Girardot et al.

[11] Patent Number: 4,617,000

[45] Date of Patent: Oct. 14, 1986

[54] MOORING BUOY WITH INDIVIDUALLY FLOATABLE MAIN BODY AND TURNTABLE

[75] Inventors: Michel Girardot; Leendert Poldervaart, both of La Turbie, France

[73] Assignee: Single Buoy Moorings, Inc., Marly, Switzerland

[21] Appl. No.: 744,882

[22] Filed: Jun. 13, 1985

Related U.S. Application Data

[63] Continuation of Ser. No. 534,199, Sep. 21, 1983, abandoned.

[30] Foreign Application Priority Data

Jun. 21, 1983 [NL] Netherlands ..... 8302203

[51] Int. Cl.[4] ..... B63B 22/02

[52] U.S. Cl. ..... 441/3; 114/230

[58] Field of Search ..... 114/230; 441/1, 3-5; 137/615; 405/195, 202

[56] References Cited

U.S. PATENT DOCUMENTS

| | | | |
|---|---|---|---|
| 3,466,680 | 9/1969 | Schirtzinger | 9/8 P |
| 3,735,435 | 5/1973 | Mikulicic et al. | 9/8 P |
| 3,742,536 | 7/1973 | Sada et al. | 441/5 |
| 3,908,212 | 9/1975 | van Heijst | 441/5 |
| 4,042,990 | 8/1977 | Donaldson | 441/5 |
| 4,279,047 | 7/1981 | van Heijst | 9/8 P |

FOREIGN PATENT DOCUMENTS

| | | |
|---|---|---|
| 57-164884 | 10/1982 | Japan . |
| 7312778 | 9/1973 | Netherlands . |
| 8200358 | 2/1982 | Netherlands . |

*Primary Examiner*—Trygve M. Blix
*Assistant Examiner*—Stephen P. Avila
*Attorney, Agent, or Firm*—Weiser & Stapler

[57] ABSTRACT

The invention relates to a buoy comprising a buoyant body with anchoring chains, a turntable on said body with a mooring for a ship. According to the invention the turntable has buoyancy as well and preferably takes part in the water displacement of the buoy. The bearing between turntable and body is preferably above water level between a central sleeve of the body and the turntable, accessible from above and located in the line from mooring point on the turntable to chain stopper on the body.

5 Claims, 4 Drawing Figures

MOORING BUOY WITH INDIVIDUALLY FLOATABLE MAIN BODY AND TURNTABLE

Figure 1:
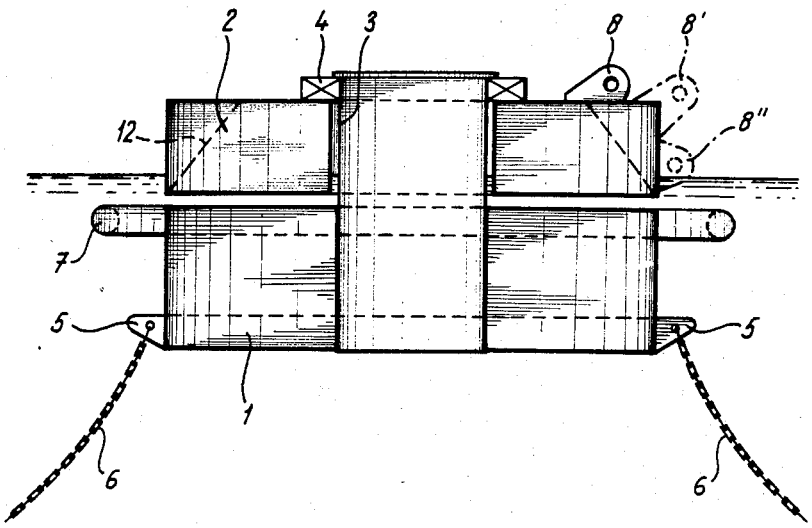

This application is a continuation of Ser. No. 534,199 filed Sept. 21, 1983, now abandoned.

The invention relates to a buoy comprising a body with buoyancy, means for anchoring the buoy, such as chain stoppers and a turntable which rotatable about a vertical axis by means of a roller—or ball bearing is supported on the buoy and is provided with means for mooring a ship.

Such a buoy is generally known in various designs. The buoy in general comprises a big cylindrical body with buoyancy, which body however, can be for instance cube-shaped as well and which at its circumference near the lower edge is provided with chain stoppers for anchoring chains extending in various directions. On the top of the buoy a turntable is present with means for fixing thereto a mooring line or with an arm fixedly connected thereto. Through a central opening pipe lines enter the buoy from the below and extend to a rotatable swivel that is mounted on the turntable, from which the pipe lines extend over the turntable to the outer side of the buoy with means such as floating hoses or the like for forming a connection with a tanker to be moored. In known buoys the turntable with pipe lines, swivel and mooring means form a heavy structure. Instead of a connection by means of anchoring chains the buoy also can be connected to the sea bottom by a tension rigid connection extending vertically downwardly.

The tanker moored to the buoy is moved from the buoy by existing wind-, wave- and current-forces, in which the return forces resulting from the anchoring means try to keep the buoy and the tanker in its position. As buoy and tanker under the influence of the wave movement mostly move independently with regard to each other greatly varying forces appear, that have to be absorbed by the mooring means and also by the bearing of the turntable. In known buoys the distance in vertical direction between the place where the anchoring means apply, such as the anchoring chains, and the bearing is great which results into high bending moments in the bearing. The great mass of the heavy turntable with associated parts promotes the swinging of the buoy and therewith also the performing bending moments.

In case the bearing of the turntable has to be repaired this mostly means that the buoy as a whole has to be removed, repaired and installed again.

The aim of the invention is to provide a buoy in which in a simple manner the loads in the bearing can be reduced, the stability can be increased and possible repairs can be simplified.

This aim in the first place is obtained by the fact that the turntable itself also is designed as a body with buoyancy.

Preferably this is done in such a manner that the turntable and the buoy body together determine the water displacement of the buoy, in which the buoy body as a whole and the turntable partly is submerged.

It also is possible to lend buoyancy to the turntable, but to keep this normally above the water level. In case swingings occur whereby the turntable also is submerged, then the buoyancy will exert a stabilizing effect, while for reparations the turntable itself after disconnection of the buoy body and of the pipe connections can be dragged away.

However, in case according to the preferred embodiment the buoy and the turntable are embodied in such a manner that both determine the water displacement, then in fact the separation face between the upper plane of the buoy body and the lower plane of the turntable is submerged. With the same water displacement as a comparable known buoy one obtains a greater stability, as the turntable floats itself, while the advantage of separated transport for repair is maintained.

It is known to provide a buoy body with a central sleeve.

According to the invention it is then advantageous to extend this sleeve upwardly through a central opening in the turntable and to position the bearing between the sleeve and the turntable, although it is also possible to provide the sleeve in two parts.

It is is now possible to keep the bearing on an easily accessible place above the turntable but it is also possible to mount it at each desired level of the turntable. By making the turntable a part of the water displacement the distance is reduced between the bearing and the line of mooring means to the chain stopper by which even in case of a bearing positioned on the upper side of the turntable the bending moment therein can be reduced. By still lower positioning it is possible that the forces which extend from the mooring means through the buoy to a mooring device extend through the bearing and the load of the bearing still can be reduced further. Moreover it is possible to position the bearing in a completely closed space, which space of course is accessible for maintenance.

Naturally the chain stoppers can be provided at a height greater than the usual lower edge of the buoy body.

Moreover according to the invention it can be advantageous to provide above the chain stopper a fender ring, that extends beyond the chain stoppers. In case a tanker crashes into the buoy the forces will be transfered in an effective manner directly to the anchoring chains.

Buoy body and turntable do not need to have the same diameter or length and width respectively. The turntable can be performed bigger or smaller and also as far as volumes go determine a greater or smaller part of the water displacement of the buoy.

The invention will now be described more in detail with the aid of the drawings.

FIG. 1 schematically shows a buoy according to the invention.

Figure 2:
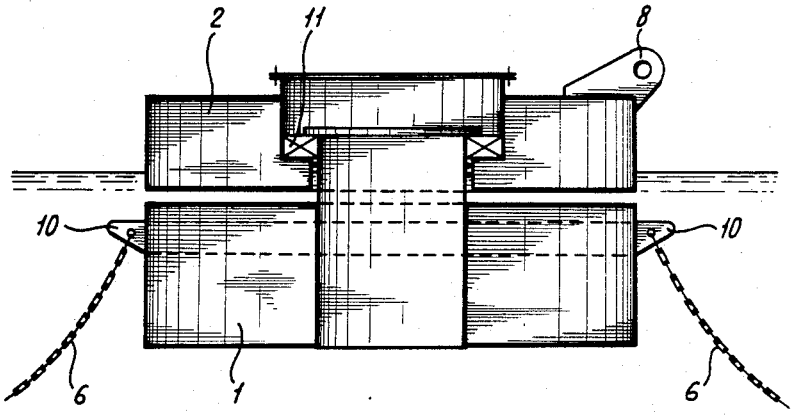

FIG. 2 shows a modification in a corresponding manner.

Figure 3:
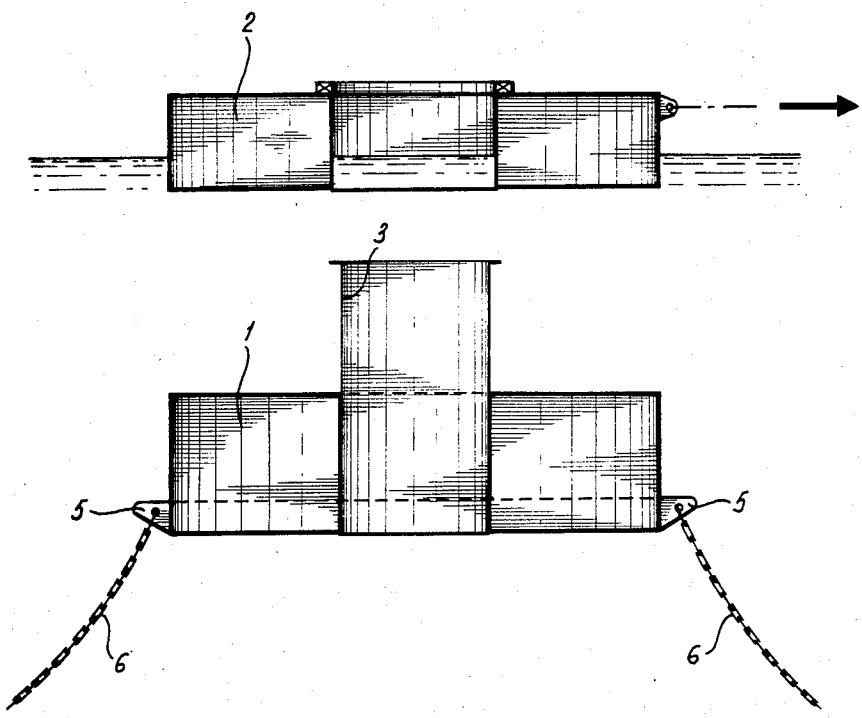

FIG. 3 schematically shows the disconnection of both parts of the buoy according to FIG. 1.

Figure 4:
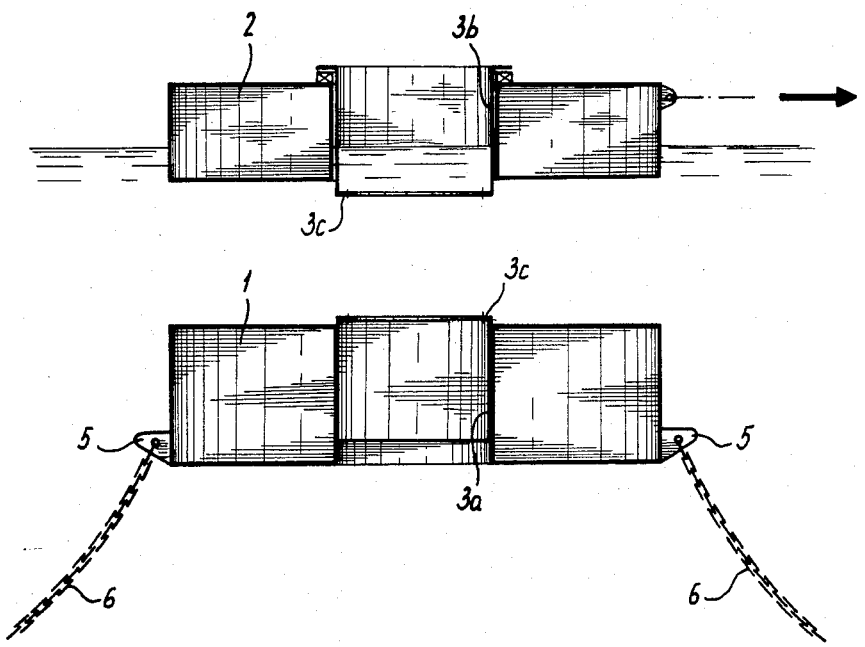

FIG. 4 shows a modification of FIG. 3.

The buoy shown in FIG. 1 comprises a buoy body 1 and a turntable 2. The buoy body comprises a central sleeve 3 and the turntable is supported by a bearing 4 on the sleeve 3 of the buoy body 1. At 5 chain stoppers for anchoring chains 6 and at 7 a fender ring are present.

With 8, 8' and 8'' respectively a connection lug is indicated for connecting an anchoring line.

The buoy body 1 has buoyancy but is completely submerged whereas the turntable 2, which also has buoyancy, is partly submerged. Both, i.e. buoy body and turntable determine the water displacement of the buoy.

FIG. 2 shows an embodiment with buoy body 1 and turntable 2 which embodiment differs from that of FIG. 1 by the fact that the chain stoppers 10 are mounted at a much higher level and the bearing 11 is present about halfway the height of the turntable 2, so that an imaginary line between connection lug and an oppositely mounted chain stopper 10 extends through the bearing 11.

FIG. 3 shows in which way if using the buoy according to the invention after disconnecting the bearing connection and decreasing the buoyancy of the buoy body 1, the turntable 2 comes free from the buoy body and for maintenance can be dragged away and of course can be replaced by another turntable.

FIG. 4 shows a modification of FIG. 3, in which the central sleeve comprises two parts 3*a* and 3*b* that can be connected to each other by a coupling 3*c*.

If used in arctic-areas it is prefered to execute the upstanding wall of the turntable 2 straight or curved truncated with the top directed upwardly. This embodiment is indicated with a broken line 12 in FIG. 1.

It also is possible to execute the buoy body 1 and also the turntable 2 straight or curved truncated with the thinnest parts adjacent to each other.

We claim:

1. A buoy exhibiting increased stability and simplified serviceability and comprising a main body having sufficient buoyancy to float individually and provided with means for the attachment of anchoring chains, a central sleeve extending upwardly from said main body, and a turntable having sufficient buoyancy to float individually from said main body and rotatably supported on said central sleeve by means of a single axial radial bearing positioned between the turntable and the central sleeve, wherein said bearing is located only at the upper end of said sleeve and above the water level with an inner ring of said bearing being secured to the central sleeve and an outer ring of said bearing being secured to said turntable.

2. The buoy of claim 1 wherein the central sleeve comprises two parts, through the main body and the turntable respectively, which parts are capable of being coupled together.

3. The buoy of claim 1 wherein said buoy includes means for attaching an anchoring line thereto, and wherein forces extending from the anchoring line attachment means through the buoy to said anchoring chain attachment means extend through said bearing.

4. The buoy of claim 3 wherein the bearing is positioned at approximately half-way the height of said turntable.

5. The buoy of claim 4 wherein said anchoring line attachment means is positioned opposite to said anchoring chain attachment means.

* * * * *